United States Patent [19]

Lubbers

[11] 4,399,941

[45] Aug. 23, 1983

[54] RAIL CLAMP

[75] Inventor: Marius H. Lubbers, The Hague, Netherlands

[73] Assignee: Everts & Van der Weyden Exploitatiemaatschappij Ewem B.V., The Hague, Netherlands

[21] Appl. No.: 253,853

[22] PCT Filed: Aug. 28, 1980

[86] PCT No.: PCT/NL80/00028

§ 371 Date: Apr. 10, 1981

§ 102(e) Date: Apr. 10, 1981

[87] PCT Pub. No.: WO81/00581

PCT Pub. Date: Mar. 5, 1981

[30] Foreign Application Priority Data

Aug. 28, 1979 [NL] Netherlands ..... 7906455

[51] Int. Cl.[3] ..... E01B 9/02

[52] U.S. Cl. ..... 238/349; 238/315; 238/351

[58] Field of Search ..... 238/310, 315, 338, 349, 238/351

[56] References Cited

U.S. PATENT DOCUMENTS

| | | | |
|---|---|---|---|
| 3,067,947 | 12/1962 | Deenik et al. | 238/349 |
| 4,025,044 | 5/1977 | Goderbauer | 238/349 |

FOREIGN PATENT DOCUMENTS

| | | | |
|---|---|---|---|
| 84930 | 4/1957 | Netherlands . | |
| 7503503 | 8/1976 | Netherlands . | |
| 7807736 | 1/1980 | Netherlands | 238/349 |

*Primary Examiner*—Randolph Reese
*Assistant Examiner*—David F. Hubbuch
*Attorney, Agent, or Firm*—Diller, Ramik & Wight

[57] ABSTRACT

A rail clamp in the form of two parts curved in the shape of a C and interconnected by a tie loop whereby the end portions of said C's exhibit fingers and the tie loop has a lock-like part for receiving at least one of said fingers.

4 Claims, 2 Drawing Figures

RAIL CLAMP

The invention relates to a rail clamp in the form of two parts curved in the form of a C and interconnected by a tie loop. Such rail clamps are used for exerting a vertically downward effort on a rail bar. Under certain conditions it may occur that the rail is exposed to a vertical upward force, for example, during repairs of the ballast bed. In this case the resilient force of the clamp may be exceeded. In order to avoid breakdown of the clamp under such conditions a recess may be provided in the housing accomodating the clamp for blocking the parts of the C-shaped clamp.

The invention has for its object to provide a cheaper solution.

According to the invention this is achieved in that the end portions of said C's are provided with fingers and the tie loop has a lock-like or flattened portion for overlying at least one of said fingers. There are two outside fingers which block the clamp from shifting in a horizontal direction relative to the housing.

The cross-section of the lock-like portion substantially corresponds to two of said fingers. The lock-like portion is located substantially in the center of the tie loop portion.

The invention will be explained with reference to the drawings.

Figure 1:
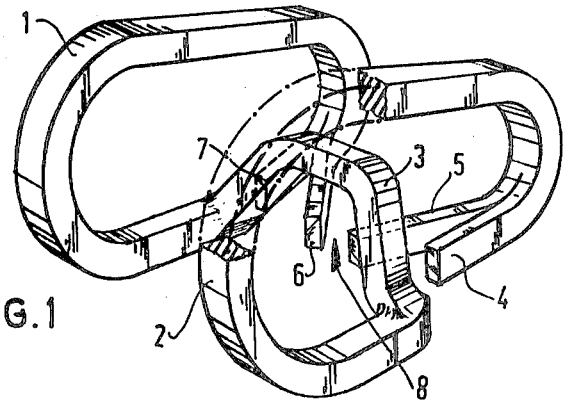
Figure 2:
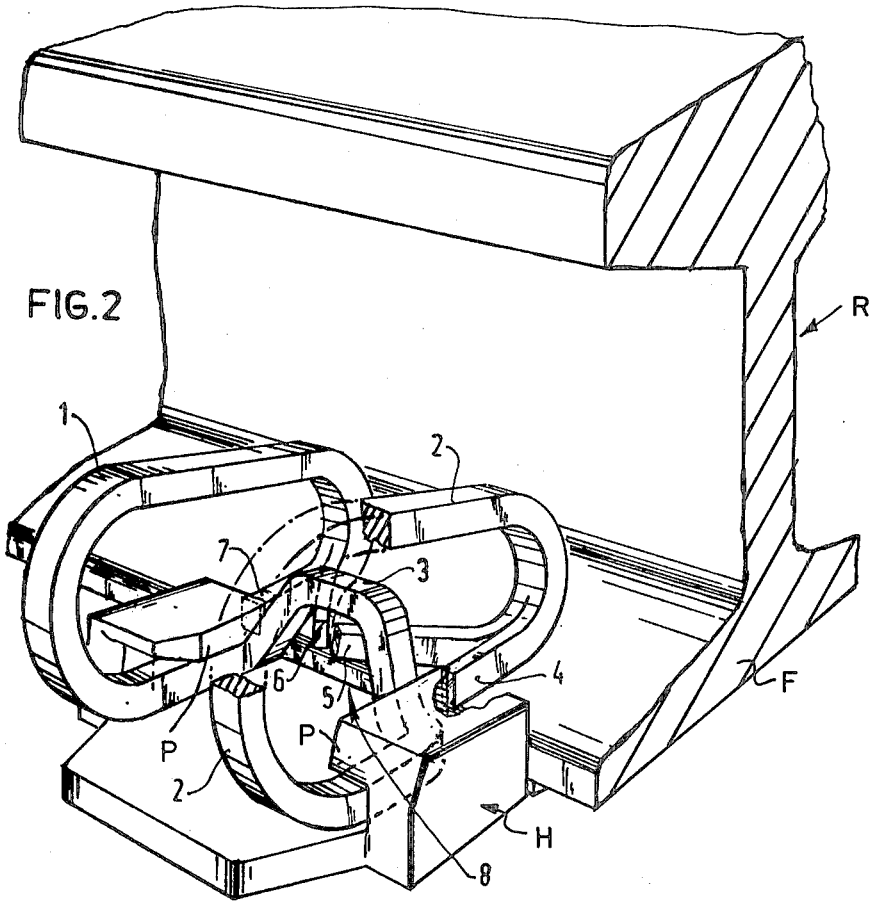

FIG. 1 is a perspective view of a rail clamp in accordance with the invention and FIG. 2 is a perspective view of a rail clamp in accordance with the invention in the mounted state.

The rail clamp according to the invention comprises two C-shaped parts 1 and 2 interconnected by a tie loop 3. The end portions of the C's are each split up into fingers 4,5, and 6,7. The tie loop 3 comprises a lock-like or flattened portion 8, into which fingers 5 and 6 of the C's can be inserted. Thus the end portions concerned are blocked in the event of upwardly directed displacements which might give rise to transgression of the resilience.

The fingers 5 and 6 are slightly longer than the fingers 4 and 7. In the operative position of the rail clamp as shown in FIG. 2, the ends of the C's which are joined by the tie loop 3 are located within recesses formed by the overhanging portions P of the housing H. As is conventional, the housing H is secured to a transverse rail tie which is supported by the usual ballast. The free ends of the C's bear upon the rail flange F and resiliently urge the rail R downwardly to maintain it properly seated as is also conventional. The tips of the fingers 4 and 7 bear against the housing H to stabilize the clamp laterally, whereas the tips of the fingers 5 and 6 underlie the flattened portion of the tie loop 3 so that if the rail R is jacked upwardly to raise the ties to permit tamping of ballast thereunder as is conventional when restoring the roadbed to proper level, and excessive force is involved, the tips of the fingers 5 and 6 may engage the loop 3.

I claim:

1. A rail clamp in the form of two parts curved in the shape of a C each C having spaced end portions, the C's being interconnected by a tie loop formed from an end portion of each C, characterized in that each of the end portions of said C's opposite said tie loop presents a plurality of fingers and the tie loop has a portion which overlies at least one of said fingers.

2. A rail clamp according to claim 1 characterized in that said portion overlies two of said fingers.

3. A rail clamp as claimed in claim 1 or 2 characterized in that said portion is located substantially in the center of the loop-shaped part.

4. A rail clamp as claimed in any one of claims 1 to 3 characterized in that the finger of each end portion underlying said portion has a greater length than the outer finger.

* * * * *